US005374871A

United States Patent [19]

Johnson

[11] Patent Number: 5,374,871

[45] Date of Patent: Dec. 20, 1994

[54] ANNULAR DOSING CAPSULE FOR ELECTRIC DISCHARGE LAMP AND METHOD OF DOSING THE LAMP USING THE CAPSULE

[75] Inventor: Wayne D. Johnson, Chardon, Ohio

[73] Assignee: General Electric Company, Schenectady, N.Y.

[21] Appl. No.: 917,563

[22] Filed: Jul. 21, 1992

[51] Int. Cl.[5] ..... H01J 9/395

[52] U.S. Cl. ..... 313/546; 313/550; 313/565; 445/9; 445/17

[58] Field of Search ..... 313/546, 490, 550, 565; 445/9, 17, 55, 53

[56] References Cited

U.S. PATENT DOCUMENTS

| | | | |
|---|---|---|---|
| 3,722,976 | 3/1973 | Porta et al. | 445/9 |
| 3,913,999 | 10/1975 | Clarke | 313/546 |
| 4,105,910 | 8/1978 | Evans | 313/490 |
| 4,494,042 | 1/1985 | Roche | 313/565 |
| 4,495,440 | 1/1985 | Schlitt et al. | 313/546 |
| 4,539,508 | 9/1985 | Mulder et al. | 313/546 |
| 4,553,067 | 11/1985 | Roche et al. | 313/546 |
| 4,823,047 | 4/1989 | Holmes et al. | 313/546 |

FOREIGN PATENT DOCUMENTS

| | | | |
|---|---|---|---|
| 2081503 | 2/1982 | United Kingdom | 313/546 X |

*Primary Examiner*—Donald J. Yusko
*Assistant Examiner*—N. D. Patel
*Attorney, Agent, or Firm*—Edward M. Corcoran; George E. Hawranko; Stanley C. Corwin

[57] ABSTRACT

An electric arc discharge lamp includes an elongated hollow tubular transparent envelope having a pair of opposite ends, a pair of electrode mounts respectively disposed in the ends of the tubular envelope, and a dosing capsule defining a hermetically sealed annular cavity containing a predetermined quantity of a dosing liquid therein. The dosing capsule has an inner edge defining an opening through the capsule for receiving a portion of one the electrode mounts therethrough such that the capsule is supported by the one electrode mount with the sealed annular cavity substantially surrounding the one electrode mount. The electrode mount includes a glass stem having inner and outer axially-displaced opposite ends, a pair of lead-in conductors extending through the glass stem and from the opposite ends of the glass stem, and an electrode supported between a pair of inner ends of the lead-in conductors adjacent to and spaced from the inner end of the glass stem. The capsule is supported about the glass stem of the electrode mount spaced from the inner and outer opposite ends thereof. The capsule is rupturable by directing heat energy through the envelope and into contact with a portion of the capsule so as to raise the temperature and cause a rupture of the capsule portion, resulting in release of the dosing liquid from the annular cavity of the capsule into the lamp envelope.

27 Claims, 4 Drawing Sheets

ANNULAR DOSING CAPSULE FOR ELECTRIC DISCHARGE LAMP AND METHOD OF DOSING THE LAMP USING THE CAPSULE

BACKGROUND OF THE INVENTION

1. Field of the Invention

The present invention relates generally to production of electric arc discharge lamps and, more particularly, to an annular dosing capsule for use in an electric discharge lamp and a method employing the capsule for dosing the lamp with the desired quantity of a dosing material, such as liquid mercury and like substances.

2. Description of the Prior Art

In the manufacture of electric discharge lamps, such as fluorescent lamps, which utilize an ionizable medium containing mercury, it is necessary to introduce a quantity of the mercury into a sealed envelope of the lamp where the mercury will be employed as a vapor in the production of light. To place the desired quantity of mercury into the fluorescent lamp, one approach has been to employ a mercury dosing apparatus. One conventional dosing apparatus utilized heretofore is operable to, first, form a droplet of liquid mercury external to the lamp and, then, blow the liquid mercury droplet into the lamp with a flush or fill gas at a stage in the lamp production process prior to hermetically closing and sealing the lamp envelope.

Due to inaccuracies of metering and losses of mercury during transport from the respective apparatus into the lamp, such prior art mercury dosing apparatus has not been found capable of dispensing a precisely or accurately measured quantity of mercury, preferably in the form of a single piece or ball of mercury, into lamps on a repeatable basis. To compensate for this deficiency, in most instances a substantially larger quantity of mercury than is actually needed for operation of the lamp is intentionally introduced to ensure that, at least, the minimum quantity of mercury will be present in the lamp envelope to provide adequate lamp performance and useful life.

Because of the adverse effects of mercury on the environment it would be highly desirable to be able to avoid the overuse of mercury in the manufacture of gas discharge lamps. Because a minimum quantity of mercury is needed in a lamp to meet design life requirements, reducing mercury in the lamp requires reducing the variability of the dosing technique.

An alternative approach to providing accurate dosing has been to sealably encapsulate the desired quantity of mercury in a heat resistive media, usually glass or metal, and attach the mercury capsule to one of the electrode mounts so that the capsule will be located inside of the lamp envelope after sealing the lamp. U.S. Pat. Nos. 4,494,042, 4,553,067 and 4,823,047 disclose this alternative approach. The purpose for using the mercury capsule is to allow the mercury to stay intact and isolated from the rest of the lamp atmosphere until after the remaining operations of sealing, exhausting and tipping of the lamp are complete. Then, by the application of intense induction heating, the capsule can be ruptured, allowing the escape of mercury into the lamp atmosphere.

In one current dosing method employing a mercury capsule, a shield has been used for attaching the mercury capsule to the electrode mount. The use of the shield has been required to provide the continuous current path needed for induction heating. However, the shield adds cost to the lamp and limits the range of potential lamp designs. Also, the use of the shield with induction heating requires the use of high cost and maintenance equipment both on the mount making machines and on equipment used subsequent to the exhaust process. The induction heating takes time, and in a high speed manufacturing operation, time translates into increase machine length and increased equipment and facility investment.

Therefore, a need remains for another approach to mercury dosing of electric discharge lamps which eliminates the problems associated with prior art mercury dosing approaches without substituting other problems in their place.

SUMMARY OF THE INVENTION

The present invention provides a dosing capsule and method designed to satisfy the aforementioned needs.

The dosing capsule and method of the present invention achieves the benefits of accurate mercury dosing without the associated design constraints and equipment and operating costs of the prior art. The present invention also has the potential for reducing the lamp material cost as well.

The dosing capsule of the present invention is a sealed rupturable annular hollow body frictionally supported about the glass stem of one of the electrode mounts in the lamp. The annular body contains a desired precise quantity of a dosing material, such as a solid or a liquid amalgam of mercury and like substances, for dosing an electric discharge lamp. The dosing method employs the dosing capsule and utilizes an external heat source to rupture the installed annular hollow body so as to carry out reliable and fast dosing of the lamp with the desired precise quantity of mercury after the hermetic sealing of the lamp envelope.

Accordingly, the present invention is directed to a dosing capsule for use in conjunction with an electrode mount of an electric discharge lamp for facilitating the dosing of a sealed envelope of the lamp with a predetermined quantity of a dosing material. The dosing capsule comprises a body defining a hermetically sealed cavity of an annular configuration for containing a predetermined quantity of a dosing material therein. The body has an inner edge defining an opening through the body for receiving therethrough a portion of the electrode mount such that the body is supported by the electrode mount with the annular cavity substantially surrounding the electrode mount.

More particularly, the capsule body includes a pair of sheets of material each having inner and outer annular portions being concentrically arranged and radially spaced relative to one another. The inner and outer annular portions of one of the sheets of material is attached to the corresponding inner and outer annular portions of the other of the sheets of material. The sheets of material also have middle annular portions located between the respective inner and outer annular portions and spaced apart from one another. The middle annular portions define the sealed annular cavity containing the predetermined quantity of dosing material.

Further, in one embodiment of the capsule, both the inner edge of the capsule body defining the opening through the body and the sealed annular cavity have endless continuous circular configurations. In the other embodiment of the capsule, the inner edge of the capsule body defining the opening has a generally U-shaped configuration beginning and ending at spaced locations on an outer peripheral edge of the capsule body, whereas the sealed annular cavity has an interrupted C-shaped configuration.

The present invention also is directed to an electric arc discharge lamp which comprises: (a) an elongated hollow tubular transparent envelope having a pair of opposite ends; (b) a pair of electrode mounts respectively disposed in the opposite ends of the hollow tubular envelope; and (c) a dosing capsule defining a hermetically sealed cavity of an annular configuration for containing a predetermined quantity of a dosing liquid therein, the capsule having an inner edge defining an opening through the capsule for receiving therethrough a portion of one of the electrode mounts such that said capsule is supported by the one electrode mount with the sealed annular cavity substantially surrounding the one electrode mount. The one electrode mount includes a glass stem having inner and outer axially-displaced opposite ends, a pair of lead-in conductors extending through the glass stem and from the opposite ends of the glass stem, and an electrode supported between the pair of inner ends of the lead-in conductors adjacent to and spaced from the inner end of the glass stem. The capsule is supported about the glass stem of the one electrode mount and is spaced from the inner and outer opposite ends thereof.

The present invention further is directed to a method of dosing an electric discharge lamp with a predetermined quantity of a dosing material. The dosing method comprises the steps of: (a) providing an elongated hollow tubular envelope; (b) providing an electrode mount disposable in an end of the tubular envelope; (c) providing a dosing capsule defining a hermetically sealed cavity containing a predetermined quantity of a dosing material therein and having an inner edge defining an opening through the capsule for receiving therethrough a portion of the electrode mount; and (d) applying the capsule about the electrode mount prior to placing the electrode mount in the end of the tubular envelope and sealing the end of the envelope such that the capsule will be supported by the one electrode mount within the envelope with the sealed annular cavity substantially surrounding the one electrode mount after the electrode mount is placed in the end of the tubular envelope.

In one embodiment, the capsule is applied about the electrode mount by moving the capsule axially over the electrode mount from an inner axial electrode-mounting end toward an outer envelope-attaching end of the electrode mount. An electrode is then attached on the electrode mount after applying the capsule about the electrode mount. In the other embodiment, the capsule is applied about the electrode mount by moving the capsule transversely across the electrode mount. The electrode is attached on the electrode mount before applying the capsule about the electrode mount.

Further, the material composing the dosing capsule is rupturable by applying heat thereto above a predetermined temperature. A heat-directing source is disposed at the exterior of the envelope after the end of the envelope is sealed. Heat energy is directed by the source through the envelope and into contact with a portion of the capsule so as to raise the capsule portion above the predetermined temperature and cause a rupture therein which releases the dosing material contained in the cavity of the capsule. More particularly, the heat-directing source is a laser and the heat energy is a laser beam generated by the laser.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
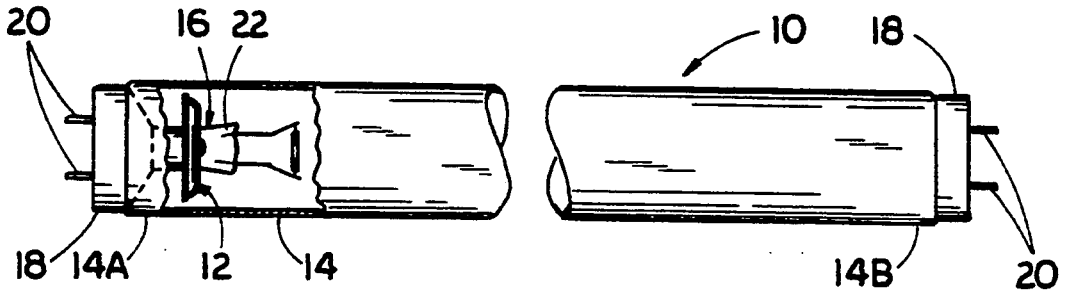
FIG. 1 is a foreshortened side elevational view of an electric arc discharge lamp with one end portion broken away to illustrate an annular liquid-containing dosing capsule of the present invention installed about an electrode mount at the one end of the lamp.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated an electric arc discharge lamp, for example, a fluorescent lamp, generally designated 10, which incorporates an annular dosing capsule 12 in accordance with the present invention for reliably dispensing a quantity of liquid mercury of desired precise or accurate size in the lamp 10. While the dosing liquid contained in the capsule 12 will be described hereinafter as liquid mercury which is commonly placed in the electric discharge lamp 10, other suitable liquids could be employed in a capsule 12 to be used for a different application.

Figure 16:
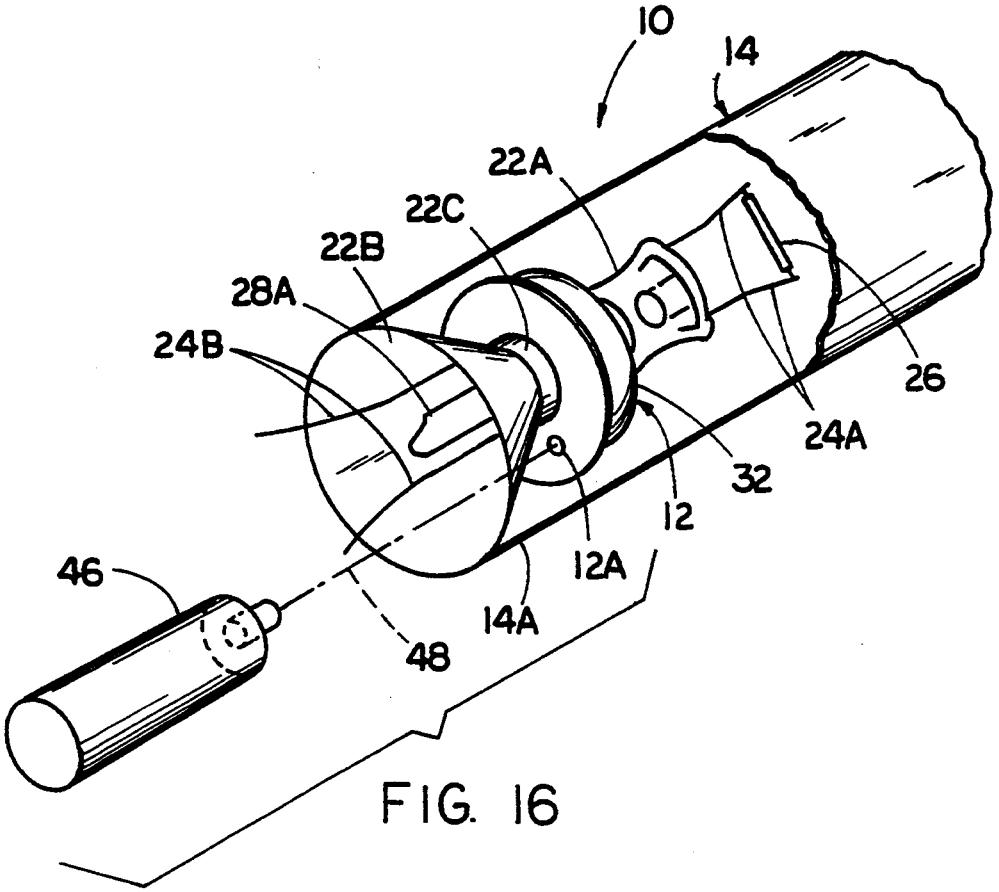
FIG. 16 is a perspective view of the one end portion of the electric arc discharge lamp of FIG. 4. illustrating the fill tube extension of the glass stem broken off and closed to hermetically seal the envelope of the lamp and illustrating a laser aligned to rupture the annular dosing capsule and cause release of the liquid dose into the sealed envelope of the lamp.
Figure 3:
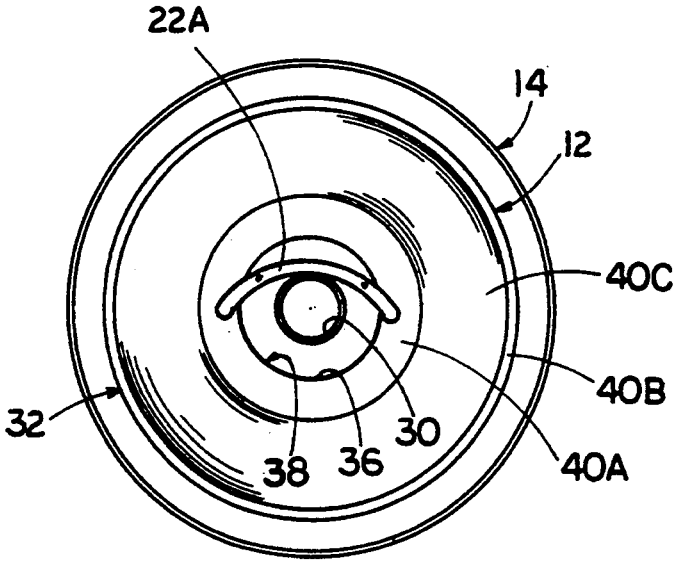
FIG. 3 is an end elevational view taken along line 3—3 of FIG. 2, illustrating a first embodiment of the annular dosing capsule of the present invention installed about the glass stem of the electrode mount.
Figure 2:
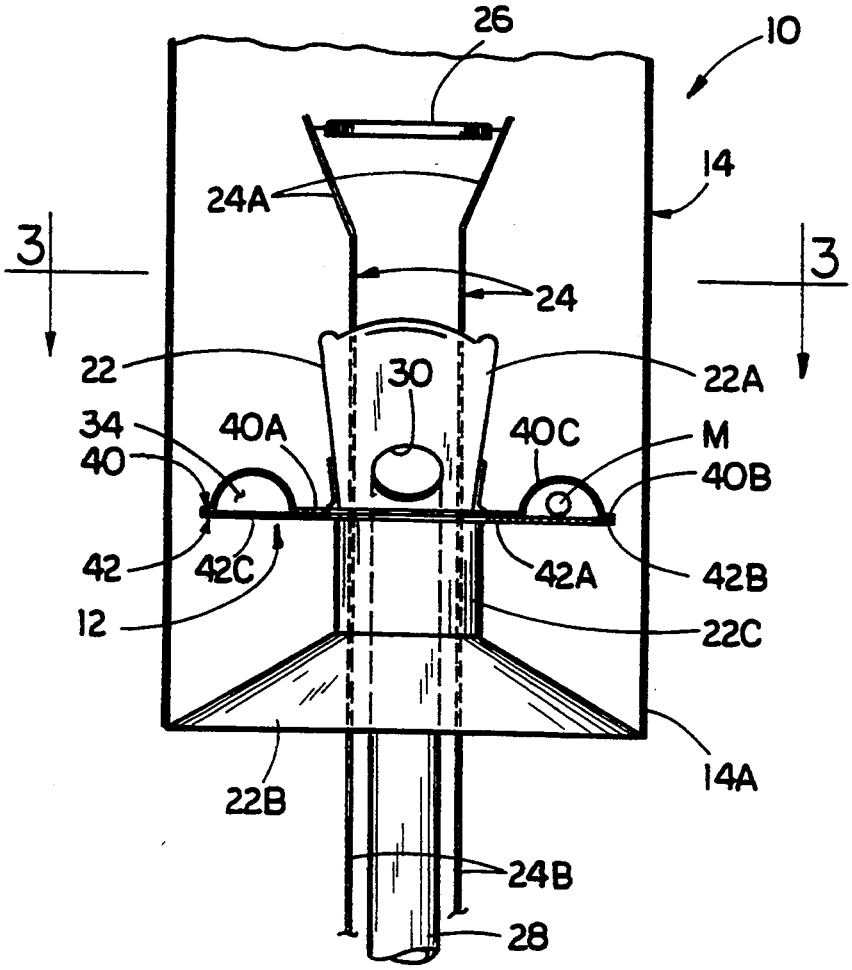
FIG. 2 is an enlarged view of the broken away end portion of the lamp of FIG. 1, illustrating the glass stem of the electrode mount after installation of the annular dosing capsule about the glass stem and of the electrode on inner ends of the lead-in conductors and illustrating an elongated fill tube extension of the glass stem prior to breaking off and closing the broken end of the fill tube extension to hermetically seal the envelope of the lamp.
Figure 4:
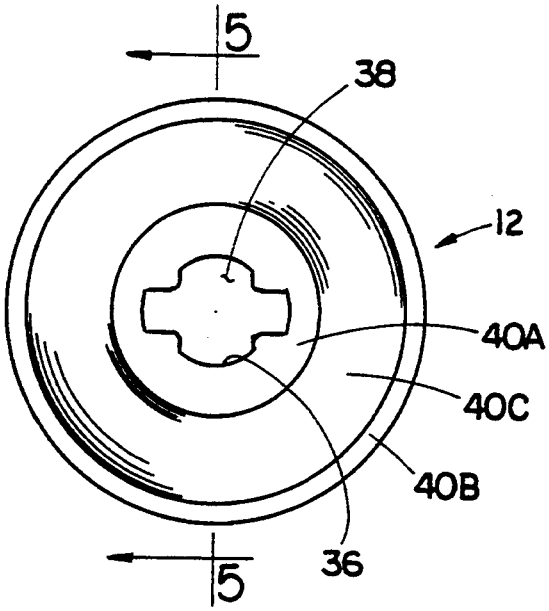
FIG. 4 is a plan view of the annular dosing capsule of FIG. 3 by itself.
Figure 5:
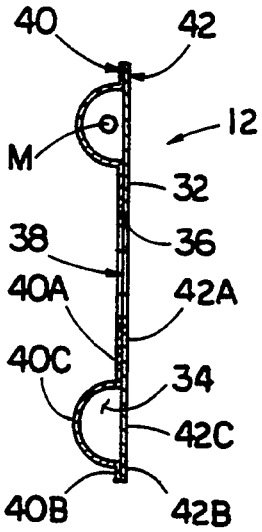
FIG. 5 is a cross-sectional view of the annular dosing capsule taken along line 5—5 of FIG. 4.
Figure 7:
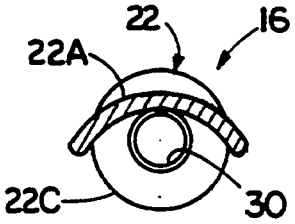
FIG. 7 is a cross-sectional view of the glass stem of the electrode mount taken along line 7—7 of FIG. 6.
Figure 8:
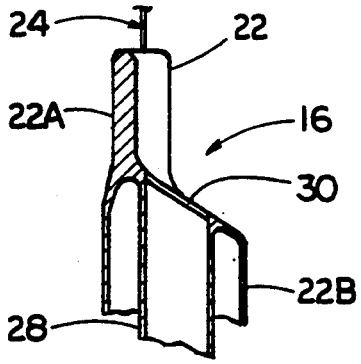
FIG. 8 is an axial sectional view of the glass stem of the electrode mount taken along line 8—8 of FIG. 6.
Figure 6:
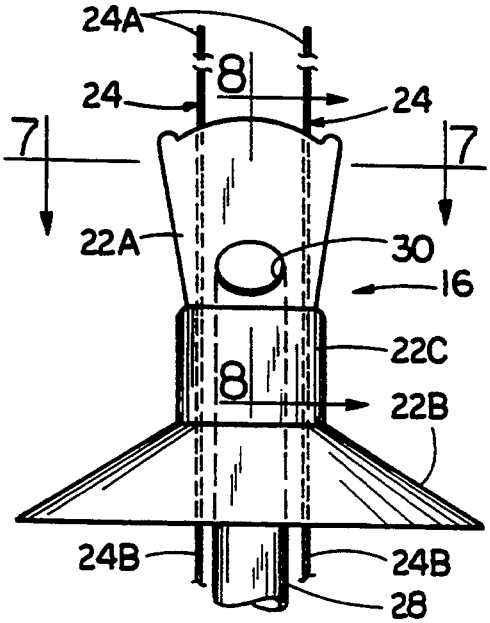
FIG. 6 is a view similar to that of FIG. 2, illustrating the glass stem of the electrode mount prior to installation of the annular dosing capsule about the glass stem and installation of the electrode on ends of the lead-in conductors.
Figure 10:
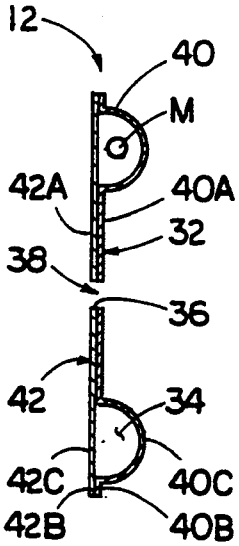
FIG. 10 is a cross-sectional view of the annular dosing capsule taken along line 10—10 of FIG. 9.
Figure 9:
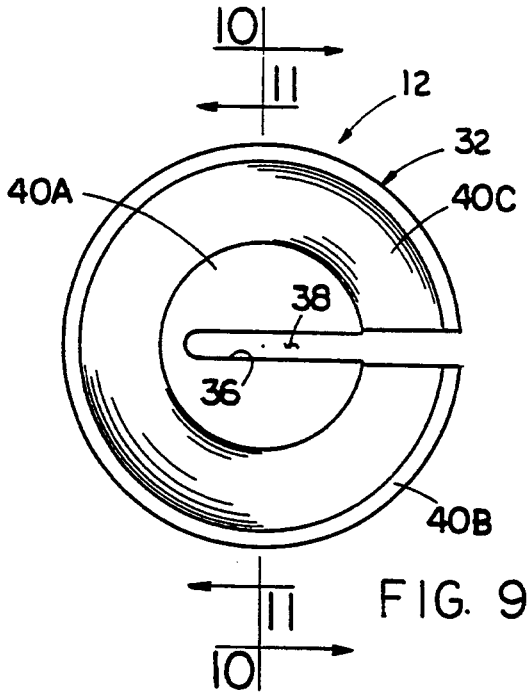
FIG. 9 is a view similar to that of FIG. 4, but illustrating a second embodiment of the annular dosing capsule of the present invention.
Figure 11:
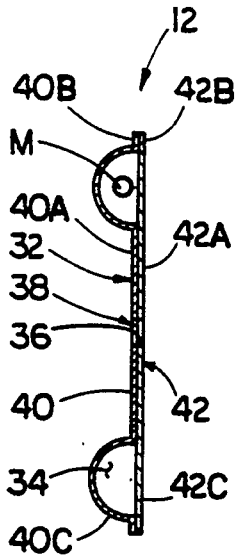
FIG. 11 is another cross-sectional view of the annular dosing capsule taken along line 11—11 of FIG. 9.
Figure 13:
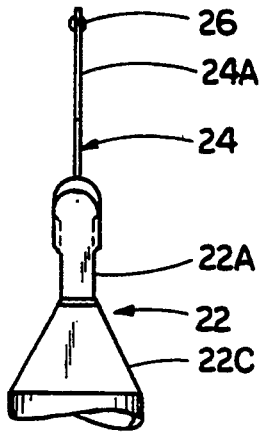
FIG. 13 is a side elevational view of the modified glass stem as seen along line 13—13 of FIG. 12, illustrating the glass stem before installation thereon of the second embodiment of the annular dosing capsule of FIG. 9.
Figure 12:
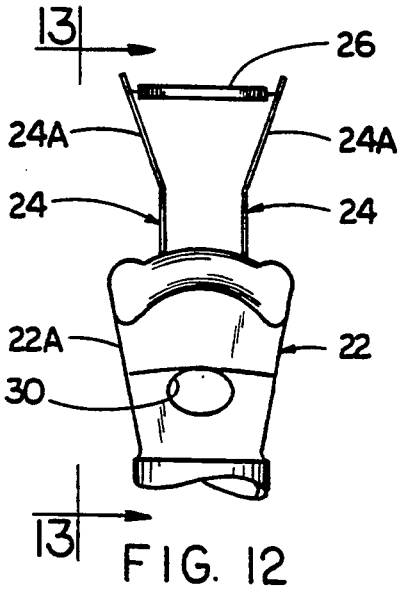
FIG. 12 is a fragmentary front elevational view of another glass stem of the electrode mount having a shape somewhat modified from that of the glass stem of FIG. 6.
Figure 14:
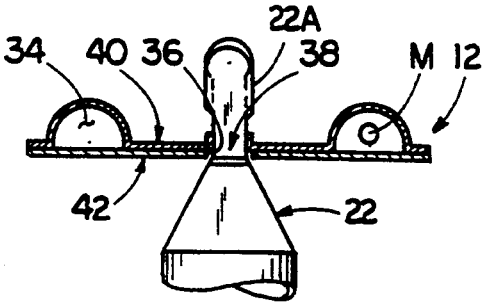
FIG. 14 is a view similar to that of FIG. 13, but illustrating the glass stem after installation of the annular dosing capsule.
Figure 15:
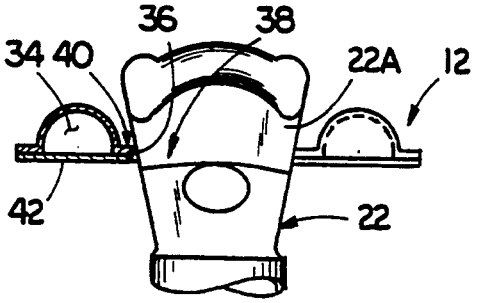
FIG. 15 is a view similar to that of FIG. 12, but illustrating the glass stem after installation of the annular dosing capsule.

The electric discharge lamp 10 includes an elongated hollow tubular transparent envelope 14 composed of a suitable material, such as glass, and having a pair of opposite ends 14A, 14B and a pair of electrode mounts 16 (only one being shown in FIG. 1) respectively disposed in and sealably connected to the opposite hollow ends 14A, 14B of the hollow tubular glass envelope 14. In addition, the lamp 10 has a pair of end caps 18 attached on the opposite ends 14A, 14B of the sealed tubular transparent envelope 14 which each support a pair of external electrical contacts 20 thereon. As shown in FIGS. 1, 2 and 16, the dosing capsule 12 of the present invention is used in conjunction with only one of the electrode mounts at one end 14A of the hollow envelope 14.

Referring to FIGS. 1–3 and 6, each electrode mount 16 includes a glass stem 22 having inner slightly arcuate or nearly flat end portion 22A, an outer flared end portion 22B and a generally cylindrical intermediate portion 22C interconnecting and axially displacing the inner and outer end portions 22A, 22B from one another. Each electrode mount 16 also includes a pair of lead-in conductors 24 extending through the glass stem 22 and extending in opposite directions from the inner and outer end portions 22A, 22B of the glass stem 22, and an electrode 26 having a coiled configuration and being supported between a pair of inner ends 24A of the lead-in conductors 24 adjacent to and but spaced from the inner end portion 22A of the glass stem 22. The pair of outer ends 24B of the leadin conductors 24 are electrically connected to the external contacts 20 mounted on the end caps 18. The electrode mount 16 also has an elongated hollow fill tube extension 28 connected to the intermediate portion 22C of the glass stem 22 so as to define an opening 30 in the inner end portion 22A of the glass stem 22 adjacent to the juncture between the inner end portion 22A and intermediate portion 22C thereof. At the conclusion of production of the lamp 10, the fill tube extension 28 is melted off and fused closed to hermetically seal the tubular envelope 14 of the lamp 10 leaving a short stub broken end 28A.

Referring now to FIGS. 1–5, there is illustrated one preferred embodiment of the dosing capsule 12 which is adapted to be supported about the glass stem 22 of the one electrode mount 16 at the juncture between the inner end portion 22A and intermediate portion 22C thereof. The dosing capsule 12 includes a body 32 defining a hermetically sealed cavity 34 having an annular configuration and a predetermined quantity of a dosing liquid, such as liquid mercury M, contained and confined therein. The capsule body 32 has an inner edge 36 defining an opening 38 through the body for receiving therethrough the inner end portion 22A of the glass stem 22 of the electrode mount 16 such that the capsule body 32 is supported by the electrode mount 16 with the sealed annular cavity 34 substantially surrounding the electrode mount 16. Spaced portions 36A of the inner edge 36 of the capsule body 32 frictionally engage the electrode mount 16 so to hold it in a stationary relation thereon. The configuration of the capsule 12 permits a form of attachment in which the capsule body 32 need not be permanently affixed to the electrode mount 16.

Preferably, the capsule body 32 is formed by a pair of sheets of material 40, 42 each having inner and outer annular portions 40A, 42A and 40B, 42B being concentrically arranged and radially spaced relative to one another. The inner and outer annular portions 40A, 40B of the one sheet of material 40 is attached, such as being welded, to the corresponding inner and outer annular portions 42A, 42B of the other sheet of material 42. The sheets of material 40, 42 also have middle annular portions 40C, 42C being located between and connected to the respective inner and outer annular portions 40A, 42A and 40B, 42B and spaced apart from one another so as to define therebetween the sealed annular cavity 34 of the capsule body 32 for containing the predetermined quantity of dosing material M. Preferably, the material of the sheets 40, 42 is a metal foil, such as stainless steel foil.

In one embodiment of the capsule 12 of FIGS. 1–5, both the inner edge 36 of the capsule body 32 defining the opening 38 through the body 32 and the sealed annular cavity 34 have endless continuous, generally circular, configurations. In the other embodiment of the capsule 12 of FIGS. 9–11, 14 and 15, the inner edge 36 of the capsule body 32 defining the opening 38 has a generally U-shaped configuration beginning and ending at spaced locations on an outer peripheral edge 44 of the capsule body 32. In this embodiment, the sealed annular cavity 34 has an interrupted, generally C-shaped configuration. The configuration of the inner end portion 22A of the glass stem 22 is slightly arcuate shaped in the embodiment of FIGS. 2, 3 and 6–8, whereas it is more flat shaped in the embodiment of FIGS. 12–15.

The dosing capsule 12 is applied to the electrode mount 16 prior to placing the electrode mount 16 into the one hollow end 14A of the tubular envelope 14 of the lamp 10 and prior to melting off the fill tube extension 28 and sealing the one end 14A of the envelope 14. The configuration of the inner end portion 22A of the glass stem 22 is slightly arcuate shaped in the embodiment of FIGS. 2, 3 and 6–8, whereas it has a more flattened shape in the embodiment of FIGS. 12–15. With respect to the configuration of the one preferred embodiment of the capsule 12 of FIGS. 1–5, the capsule 12 is applied about glass stem 22 of the electrode mount 16 having the configuration of FIGS. 1–5 by moving the capsule 12 axially over the electrode mount 16 from the inner electrode-mounting end portion 22A of the glass stem 22 toward the middle and outer end portions 22C, 22B thereof. Since in order to mount the electrode 26 to the inner ends 24A of the lead-in conductors 24, the inner ends 24A must be spread apart, from their respective parallel relationship shown in FIG. 6 to their respective divergent relationship shown in FIG. 2, through a distance greater than the diameter size of the opening 38 in the capsule body 32, the inner ends 24 of the conductors 24 will be spread outwardly and the electrode 26 then attached thereon after the capsule 12 has been applied or placed over and about the glass stem 22 of the electrode mount 16. With respect to the configuration of the other preferred of the capsule 12 of FIGS. 9–11, the capsule 12 is applied about the flattened inner end portion 22A of the glass stem 22 of the electrode mount by aligning its elongated opening 38 with the glass stem 22 and then moving the capsule 12 transversely across the electrode mount 16. The electrode 26 can be attached on the electrode mount 16 either before or after application of the capsule 12 about the electrode mount 16.

As mentioned previously, preferably the material composing the dosing capsule 12 is a metal foil, such as stainless steel, which is rupturable by applying heat thereto above a predetermined temperature. Referring to FIG. 16, a suitable heat-directing source 46, preferably a laser, can be disposed at the exterior of the envelope 14 after the ends of the envelope are sealed. Heat energy is generated by a laser beam 48 being directed through the envelope 14 and into contact with a portion 12A of the capsule 12 which is sufficient to raise the temperature of the contacted capsule portion 12A above the predetermined rupture temperature of the material and thereby cause a pierce or rupture therein which releases into the sealed envelope 14 the dosing liquid mercury M contained in the annular cavity 34 of the capsule 12.

In summary, the dosing capsule 12 of the present invention is a sealed rupturable annular hollow body 32 frictionally supported, but not permanently attached, about the glass stem 22 of one of the electrode mounts 16 in the lamp 10. The annular body 32 contains a desired precise quantity of a dosing material, such as liquid mercury M and like substances, for dosing the electric discharge lamp 10 after the envelope 14 has been sealed. The method of dosing the lamp 10 contemplates installing the dosing capsule 12 and utilizing an internal heat source, for instance, conventional induction heating, or an external heat source, such as a laser, to pierce or rupture the installed annular hollow body 32 so as to carry out reliable and fast dosing of the lamp 10 with the desired precise quantity of mercury M after the hermetic sealing of the lamp envelope 14. The use of the laser 46 is preferred in order to provide a very rapid method of breaking the capsule 12. The design of the capsule 12 presents a large and non-oriented target to permit easy aiming of laser 46 and to provide a high degree of certainty that the laser beam 48 will actually hit and pierce the capsule 12. This maximizes the reliability of the mercury release process.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A dosing capsule for use in conjunction with an electric arc discharge lamp; comprising:

(a) a body defining a hermetically sealed cavity for containing a predetermined quantity of a dosing material therein;

(b) said body having an inner edge defining an opening through said body for receiving therethrough a portion of an electrode mount of the lamp such that said body will be supported by the electrode mount with said sealed cavity of said body substantially surrounding the electrode mount and (c) wherein said body is annularly shaped and is mounted in a mechanically fit manner on said electrode mount and at a position spaced axially apart from an electrode disposed at one end of said electrode mount, said body having said sealed cavity formed along at least a substantial portion of the periphery thereof.

2. The capsule as recited in claim 1, wherein said body includes a pair of sheets of material each having inner and outer annular portions being concentrically arranged and radially spaced relative to one another, said inner and outer annular portions of one of said sheets of material being attached to said corresponding inner and outer annular portions of the other of said sheets of material, said sheets of material also having middle annular portions being located between said respective inner and outer annular portions and spaced apart from one another so as to define said sealed cavity for containing the predetermined quantity of dosing material.

3. The capsule as recited in claim 2, wherein said material of said sheets is a heat-rupturable metal foil.

4. The capsule as recited in claim 2, wherein said inner and outer annular portions of said sheets of material are welded together.

5. The capsule as recited in claim 1, wherein said inner edge of said body defining said opening through said body has a continuous configuration of an essentially circular shape.

6. The capsule as recited in claim 1, wherein said inner edge of said body defining said opening through said body has a generally U-shaped configuration beginning and ending at spaced locations on an outer peripheral edge of said body.

7. The capsule as recited in claim 1, wherein said sealed cavity has a continuous configuration of an essentially circular share.

8. The capsule as recited in claim 1, wherein said sealed cavity has an interrupted configuration.

9. The capsule as recited in claim 8, wherein said sealed cavity has a generally C-shaped configuration.

10. An electric arc discharge lamp, comprising (a) an elongated hollow tubular envelope having a pair of opposite ends;

(b) a pair of electrode mounts respectively disposed in said ends of said hollow tubular envelope;

(c) a dosing capsule defining a hermetically sealed cavity for containing a predetermined quantity of a dosing material therein, said capsule having an inner edge defining an opening through said capsule for receiving therethrough a portion of one of said electrode mounts such that said capsule is supported by said one electrode mount with said sealed cavity substantially surrounding said one electrode mount and (c) wherein said dosing capsule is annularly shaped and is mounted in a mechanically fit manner on said electrode mount and at a position spaced axially apart from an electrode disposed at one end of said electrode mount, said dosing Capsule having said sealed Cavity formed along at least a substantial portion of the periphery thereof.

11. The lamp as recited in claim 10, wherein at least said one electrode mount includes:

a glass stem having inner and outer axially-displaced opposite ends;

a pair of lead-in conductors extending through said glass stem and from said opposite ends of said glass stem; and said electrode is supported between said pair of inner ends of said lead-in conductors adjacent to and spaced from said inner end of said glass stem.

12. The lamp as recited in claim 10, wherein said capsule includes a pair of sheets of material each having inner and outer annular portions being concentrically arranged and radially spaced relative to one another, said inner and outer annular portions of one of said sheets of material being attached to said corresponding inner and outer annular portions of the other of said sheets of material, said sheets of material also having middle annular portions being located between said respective inner and outer annular portions and spaced apart from one another so as to define said sealed cavity for containing the predetermined quantity of dosing material.

13. The lamp as recited in claim 12, wherein said material of said sheets is a heat rupturable metal foil.

14. The lamp as recited in claim 12, wherein said inner and outer annular portions of said sheets of material are welded together.

15. The lamp as recited in claim 10, wherein said inner edge of said capsule defining said opening through said capsule has a continuous configuration of an essentially circular shape.

16. The lamp as recited in claim 10, wherein said inner edge of said capsule defining said opening through said capsule has a generally U-shaped configuration beginning and ending at spaced locations on an outer peripheral edge of said capsule.

17. The lamp as recited in claim 10, wherein said sealed cavity has a continuous configuration of an essentially circular shape.

18. The lamp as recited in claim 10, wherein said sealed cavity has an interrupted configuration.

19. The lamp as recited in claim 18, wherein said sealed cavity has a generally C-shaped configuration.

20. A method of dosing an electric arc discharge lamp, comprising the steps of:

(a) providing an elongated hollow tubular envelope;

(b) providing an electrode mount disposable in an end of the hollow tubular envelope;

(c) providing an annularly shaped dosing capsule defining a hermetically sealed cavity containing a predetermined quantity of a dosing material therein and having an inner edge defining an opening through the capsule for receiving therethrough a portion of the electrode mount;

(d) mounting said dosing capsule in a mechanically fit manner on said electrode mount at a position spaced apart from an electrode member;

(e) applying the capsule about the electrode mount prior to placing the electrode mount in the end of the hollow tubular envelope and sealing the end of the envelope such that the capsule will be supported by the one electrode mount within the envelope with the sealed cavity substantially surrounding the one electrode mount after the electrode mount is placed in the end of the tubular envelope and (f) rupturing the capsule so as to allow release of the dosing material into the tubular envelope.

21. The method as recited in claim 20, further comprising:

attaching said electrode on the electrode mount after applying the capsule about the electrode mount.

22. The method as recited in claim 20, further comprising:

attaching said electrode on the electrode mount before applying the capsule about the electrode mount.

23. The method as recited in claim 20, further comprising:

applying the capsule about the electrode mount by moving the capsule axially over the electrode mount from an inner axial electrode-mounting end toward an outer envelope-attaching end of the electrode mount.

24. The method as recited in claim 20, further comprising:

applying the capsule about the electrode mount by moving the capsule transversely across the electrode mount.

25. The method as recited in claim 20, wherein the material composing the dosing capsule is rupturable by applying heat thereto above a predetermined temperature.

26. The method as recited in claim 25, further comprising:

disposing a heat-directing source at the exterior of the envelope after the end of the envelope is sealed; and directing heat energy through the envelope and into contact with a portion of the capsule so as to raise the capsule portion above the predetermined temperature and cause a rupture therein which releases the dosing material contained in the annular cavity of the capsule.

27. The method as recited in claim 26, wherein said heat-directing source is a laser and said heat energy is a laser beam generated by the laser.

* * * * *